US005160296A

United States Patent [19]

Katz

[11] Patent Number: 5,160,296

[45] Date of Patent: Nov. 3, 1992

[54] DIRECTORY TAB FOR ORGANIZING AND TRACKING FILES

[76] Inventor: Solomon Katz, 38 Vista Del Mar, Dana Point, Calif. 92629

[21] Appl. No.: 674,122

[22] Filed: Mar. 25, 1991

[51] Int. Cl.[5] ..... B42F 21/00

[52] U.S. Cl. ..... 462/6; 40/359; 283/36

[58] Field of Search ..... 283/36, 64; 281/45; 462/6, 26; 40/359, 360

[56] References Cited

U.S. PATENT DOCUMENTS

| | | | |
|---|---|---|---|
| 1,435,664 | 11/1922 | Russell | 283/36 X |
| 4,143,477 | 3/1979 | Reynolds | 283/36 X |
| 4,218,838 | 8/1980 | Zippel | 283/36 X |

*Primary Examiner*—Timothy V. Eley
*Assistant Examiner*—William Fridie

[57] ABSTRACT

This directory tab would aid in organizing and tracking files in a suspended filing system. The quick reference directory saves the user time and provides a handy at-a-glance feature to a filing system. This directory tab is designed to eliminate sorting through a suspended folder; it allows the user to look at the directory and visually see what's in a folder. Its design also permits additions or deletions in a quick and efficient manner. The directory tab is designed to allow office personnel who are in need of a particular item within a suspended file folder the ability to date and initial the directory tab. In doing so, the next user that comes along needing the same information will be able to identify who has it in a quick and efficient manner.

6 Claims, 3 Drawing Sheets

SHEET 3 OF 3

DIRECTORY TAB FOR ORGANIZING AND TRACKING FILES

BACKGROUND

1. Field of Invention

This invention relates to suspended file folders, for the use in better organizing and tracking of files.

2. Description of Prior Art

Many, if not most users of suspended file folders have the need to keep detailed descriptions of their contents; as well as a system which allows the user to easily locate who has a file at all times.

Reynolds, U.S. Pat. No. 4,143,477, discloses an index tab that is attached to the outside of a file folder. The Reynolds invention has a rotating strip that comes with pre-printed tabs. Disadvantages to the Reynolds invention are: tab hooking on outside of folder would get caught on other folds, and would become easily worn out. A pre-printed tab leaves user feeling as though they have to follow a "new" system.

Raymond, U.S. Pat. No. 4,053,057, discloses a suspended file folder wherein a plastic tab can be inserted into notches of the suspended folder. Disadvantages to this tab are: too small of a space to put down exactly what's in folder, so that the user is forced to put a broad term to describe contents.

Most users, therefore, would find it desirable to have a moveable directory tab made of a non-porous material (which provides a write on/wipe off advantage to users). It is housed in a rigid plastic frame, that is attached to pre-existing slots in a suspended folder. This invention provides a new and improved variable tab for a suspended file folder which requires no modification to the folder and which, furthermore, is reasonably inexpensive to produce. By implementing use of this directory tab the user no longer needs to type on tab, the user simply write down a folders contents and when changes or updates are needed the user erases and makes necessary revisions.

Another advantage of this invention is to give the user the capability to track who has taken information out of a suspended folder. By simply marking your initials and dating, the next user will know who has the information needed.

OBJECT AND ADVANTAGES

Accordingly we claim the following as our objects and advantages of said invention: to provide a directory tab which is easily accessible, is changeable, and allows the ability to track files in a simple and efficient manner.

In addition we claim the following additional objects and advantages: to provide a directory tab supported in a rigid plastic frame which is inserted into pre-existing notches of a suspended folder. The directory tab has a non-porous surface suitable for erasing. The directory tab may be removed completely for writing or erasing purposes. Additions and/or deletions can be made with the relative ease. The directory tab is easily accessed by the user pulling up on tab.

In an office setting many people have access to the same filing drawers/cabinets. Many times individual files must be removed from within the suspended folders. By implementing this invention into everyday office life the user can initial and date appropriate file(s), thus ending the missing-file-syndrome.

This invention embodies a novel combination of a suspended file folder with a directory tab. This tab can be the size indicated in the drawings or customized to fit any dimension that can be housed in a suspended file folder.

Readers will find further objects and advantages of the invention from the following description and accompanying drawings.

DRAWING FIGURES

DRAWING REFERENCE NUMERALS

6 directory tab (or card)
8 rigid plastic support frame (or strap)
10 protective back (or panel)
12 adhesive strip that is connected to frame 8
14 adhesive strip that is connectable to folder 16.
16 suspended file folder.
18 modified frame or strap
20 cut-out flap or panel

DIRECTORY TAB—DESCRIPTION

Figure 1:
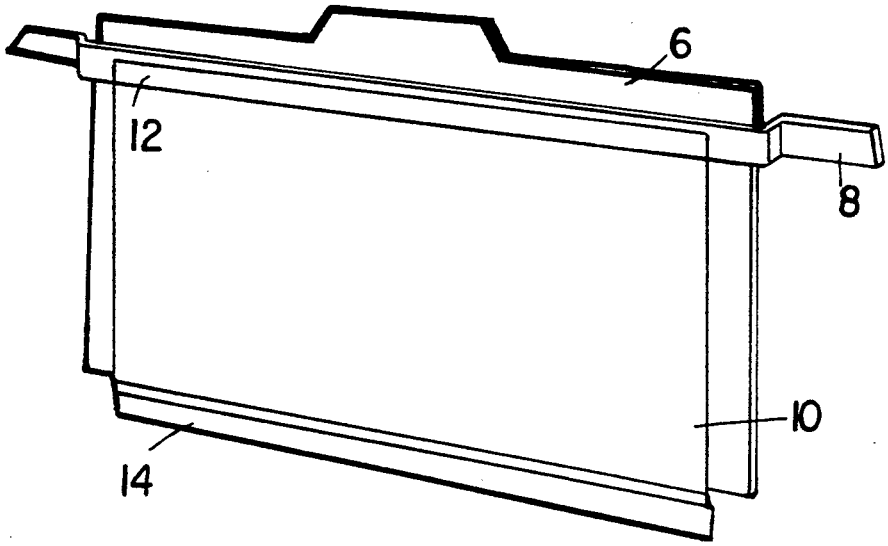
FIG. 1 shows moveable directory tab with frame and protective backing.

FIG. 1 shows a directory card 6 coated with a non-porous surface suitable for erasably receiving marking ink. One such marking pen for writing on this surface is a "VIS-A-VIS" (trademark)(Sanford Corp. of Bellwood, Ill.). FIG. 1 also shows the rigid plastic support strap 8 and the protective panel 10 to keep the directory card from slipping and catching on files within the suspended folder 16.

Figure 2:
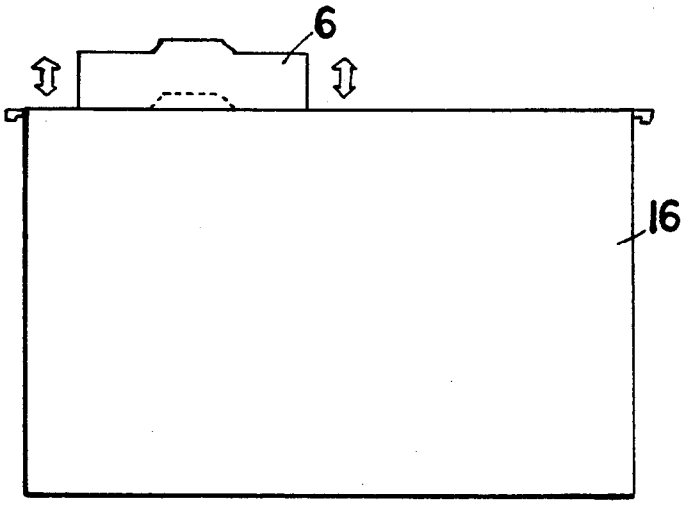
FIG. 2 shows directory tab merging from top of suspended file folder.

FIG. 2 shows a directory card 6 merging out from suspended file folder 16. This card 6 can be taken completely out of its frame 8 for easy marking (not shown). When additions and/or deletions are made card 6 is replaced.

Figure 3:
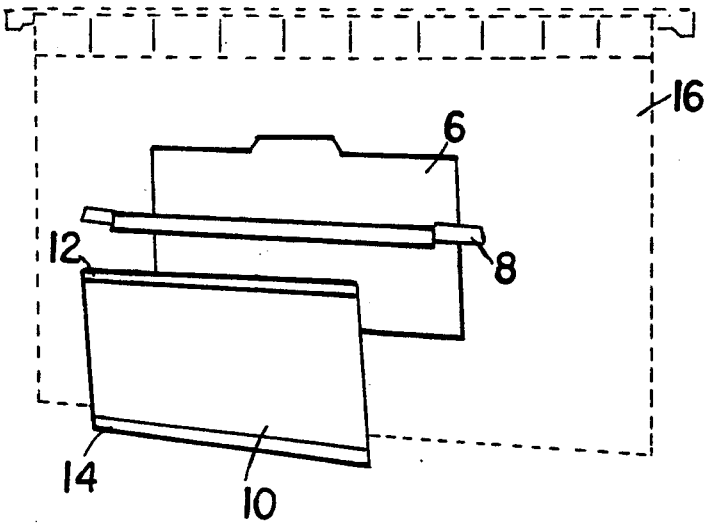
FIG. 3 shows an exploded view of invention.

FIG. 3 shows an exploded view of the invention. The directory card 6, strap 8 with protective panel 10 and a suspended folder 16 are shown separated from each other prior to assembly together.

DIRECTORY TAB—OPERATION

This directory card 6 (shown in FIG. 1) is used as a quick reference guide showing a files contents. When using this system the user is required to insert support strap 8 into pre-existing slots, adhere protective panel 10 to strap 12 and suspended folder 16. The user than writes up directory card 6 telling what's in suspended folder 16 and simply inserts completed directory card 6 into strap 8 and the attached panel 10.

This directory card 6 has another feature, the ability to track when information has been removed from a suspended folder 16. Suspended file folders 16 usually remain in a cabinet and only its contents are removed. Implementing this particular aspect of the said invention is easy. User simply removes directory card 6 writes his/her initials and the date next to the item that is being removed. In doing so the next user that comes along needing the same information will know who has it at a quick glance.

It is important to note that this system will not interfere with existing suspended file folders 16. A directory card 6 with strap 8 and protective panel 10 are all that is needed.

Figure 4:
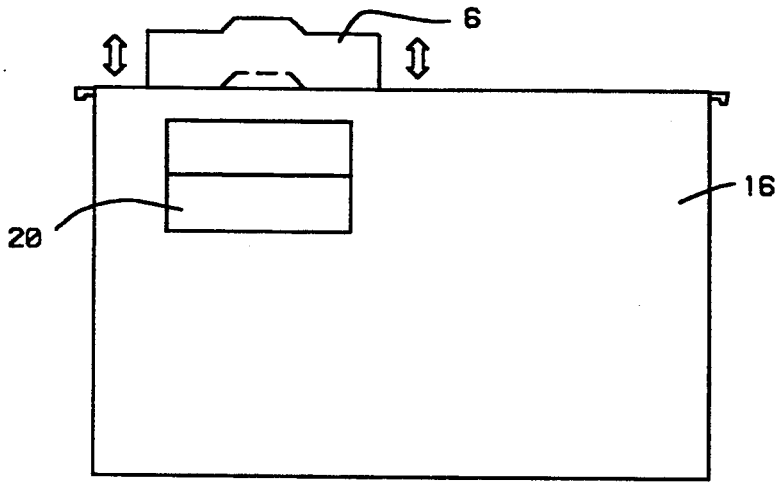
FIGS. 4 and 5 shows an alternative embodiment of the invention, with an additional feature of a file folder with a window.
Figure 5:
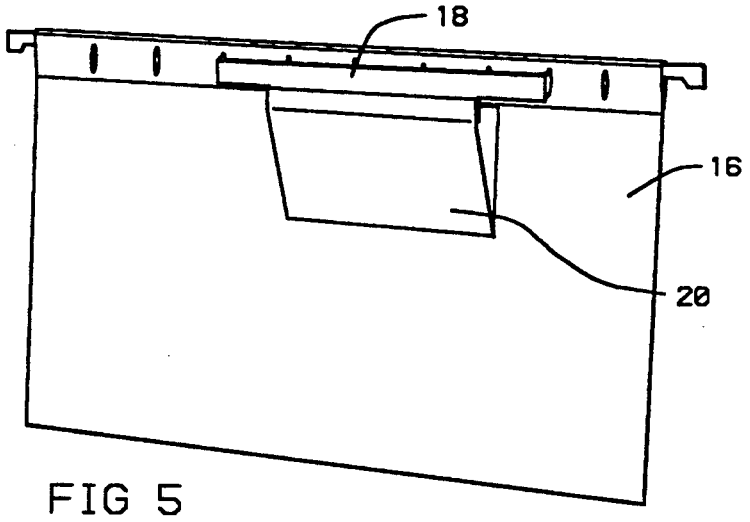

However, in accordance with an alternative embodiment to the invention two functions are introduced. The cut-out flap 20, which acts as a window, allows you to see the directory card 6 by simply looking at suspended file folder 16. Since the window is a cut-out flap 20 of file folder 16 it performs the same function as panel 10 in the FIG. 1 embodiment. Panel 10 (or 20) is attached to the central portion of strap 18 to form a pocket for removably receiving card 6. The lower edge portion of panel 10 (or 20) is attached to the associated wall of the file folder 16 to define the lower limit of the pocket. When card 6 is fully inserted into the defined pocket an upper portion of the card projects above the upper edge of the file folder, as shown in dashed lines in FIGS. 2 and 4. As best seen in FIG. 1, the end portions of strap 18 are offset from the central portion of the strap so that when the strap end portions are extended into the slots in the file folder wall the strap central portion is spaced from the file folder wall.

We claim:

1. In a suspended file folder having two vertical spaced vertical walls for storage of documents therebetween, each vertical wall having an exposed upper edge, one of said walls having a series of slots therein at spaced points along its upper edge: the improvement comprising an informational directory device carried on the upper edge of said one wall; said directory device comprising a relatively rigid linear strap (8) having opposite ends, said strap being oriented horizontally on said one wall with opposite ends thereof extending into selected ones of said slots whereby the strap is attached to the file folder, a pocket-forming panel having an upper edge and a lower edge, said panel having an upper portion thereof engaged flatwise against said strap, the upper portion of said panel being connected to the strap but not to the file folder so that an upwardly-open mouth is formed between said panel and the plane of said one file folder wall, the lower edge portion of said panel being connected to said one wall to define the lower limit of the pocket, and an information-containment card insertable downwardly into said pocket through said upwardly-open mouth; said card being withdrawable upwardly out of the pocket for viewing or placement of information thereon.

2. The improvement of claim 1, wherein said card has an upper portion thereof projecting above the upper edge of said one file folder wall when the card is fully inserted into the pocket.

3. The improvement of claim 1, wherein said panel has a horizontal width dimension that is less than the length of said strap whereby the end portions of the strap extend laterally beyond the panel for extension into the slots in said one folder wall.

4. The improvement of claim 3, wherein said strap has a central portion slightly longer than the width dimension of said panel, said strap having end portions that are offset from the plane of the strap central portion so that when said strap end portions are extended into said slots the strap central portion will be spaced from the plane of said one folder wall.

5. The improvement of claim 1, wherein said panel has an adhesive means on the lower edge thereof, whereby said panel is adhesively attached to said one file folder wall.

6. The improvement of claim 1, wherein said panel is formed as a flap (20) cut out of said one file folder wall.

* * * * *